US008784916B2

(12) United States Patent
Zotter

(10) Patent No.: US 8,784,916 B2
(45) Date of Patent: Jul. 22, 2014

(54) PACKAGING FOR TWO OR MORE BARS LOCATED ONE ABOVE THE OTHER

(75) Inventor: Josef Zotter, Gleisdorf (AT)

(73) Assignee: Zotter Holding GmbH & Co. KG, Kornberg Bei Riegersburg (AT)

( * ) Notice: Subject to any disclaimer, the term of this patent is extended or adjusted under 35 U.S.C. 154(b) by 881 days.

(21) Appl. No.: 12/520,357

(22) PCT Filed: Nov. 29, 2007

(86) PCT No.: PCT/AT2007/000534
§ 371 (c)(1),
(2), (4) Date: Jun. 30, 2009

(87) PCT Pub. No.: WO2008/074040
PCT Pub. Date: Jun. 26, 2008

(65) Prior Publication Data

US 2010/0044263 A1 Feb. 25, 2010

(30) Foreign Application Priority Data

Dec. 21, 2006 (AT) ..... A 2117/2006

(51) Int. Cl.
*B65D 5/50* (2006.01)
*B65D 85/60* (2006.01)
*B65D 65/10* (2006.01)

(52) U.S. Cl.
CPC ..... *B65D 85/60* (2013.01); *B65D 65/10* (2013.01)
USPC ..... 426/119; 426/108; 426/106; 206/449; 206/472; 229/87.08

(58) Field of Classification Search
CPC ..... B65D 85/60; B65D 65/10; B65D 71/066; B65D 2575/58
USPC ..... 426/5, 87, 94, 104, 106, 119; 206/449; 229/87.01, 87.06, 87.07, 87.5
See application file for complete search history.

(56) References Cited

U.S. PATENT DOCUMENTS

| | | | | | |
|---|---|---|---|---|---|
| 36,710 | A | * | 10/1862 | Hamlin | 383/39 |
| 469,733 | A | * | 3/1892 | Brewer | 206/449 |
| 690,937 | A | * | 1/1902 | Fancher | 229/87.5 |
| 924,275 | A | * | 6/1909 | Richardson | 206/585 |
| 1,681,700 | A | * | 8/1928 | Folmer | 206/521.6 |
| 1,879,952 | A | * | 9/1932 | Rosen | 206/476 |

(Continued)

FOREIGN PATENT DOCUMENTS

| | | |
|---|---|---|
| DE | 864976 | 1/1953 |
| DE | 1997266 | 11/1968 |

(Continued)

*Primary Examiner* — Rena L Dye
*Assistant Examiner* — Chaim Smith
(74) *Attorney, Agent, or Firm* — Workman Nydegger

(57) ABSTRACT

A packaging for foodstuffs and/or semi-luxury products produced in the form of bars, such as chocolate bars, containing two or more bars lying on top of each other, wherein each bar is wrapped in a sheet on all sides and the bars thus wrapped are enveloped by a wrapper sheet, characterized in that all bars lie flatly on top of each other in the form of a stack of bars and all bars lying on top of each other are embraced by a single continuous wrapper sheet, namely on at least three adjacent sides of each individual bar, with all fold lines of the wrapper sheet running parallel to each other.

16 Claims, 10 Drawing Sheets

(56) References Cited

U.S. PATENT DOCUMENTS

Figure 1:
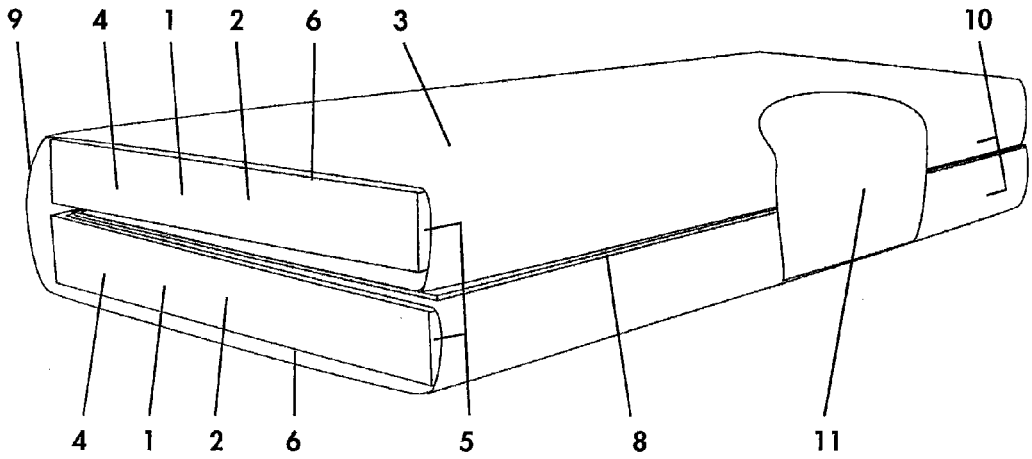

| | | | | | |
|---|---|---|---|---|---|
| 1,883,852 | A | * | 10/1932 | Medoff | 206/449 |
| 2,192,473 | A | | 10/1936 | Huston | |
| 2,210,194 | A | | 10/1938 | Baldwin | |
| 2,210,196 | A | | 11/1938 | Baldwin | |
| 2,158,971 | A | * | 5/1939 | Stratton | 206/258 |
| 2,476,923 | A | * | 7/1949 | Sogas et al. | 426/108 |
| 2,745,596 | A | * | 5/1956 | Lorenzsonn | 229/87.08 |
| 2,775,397 | A | * | 12/1956 | Vogt | 229/87.08 |
| 2,959,338 | A | * | 11/1960 | Thurston | 229/120.09 |
| 3,130,058 | A | * | 4/1964 | Johnson | 426/87 |
| 3,835,987 | A | * | 9/1974 | Growney | 206/747 |
| 5,573,438 | A | * | 11/1996 | D'Andrea | 446/149 |
| 2002/0114863 | A1 | * | 8/2002 | Ream et al. | 426/3 |
| 2005/0252809 | A1 | | 11/2005 | Aldridge et al. | |

FOREIGN PATENT DOCUMENTS

| | | | | | |
|---|---|---|---|---|---|
| DE | 9100629 | U1 | | 1/1991 | |
| DE | 10102959 | A1 | | 7/2002 | |
| WO | WO 2004/071895 | | * | 8/2004 | B65D 73/00 |

* cited by examiner

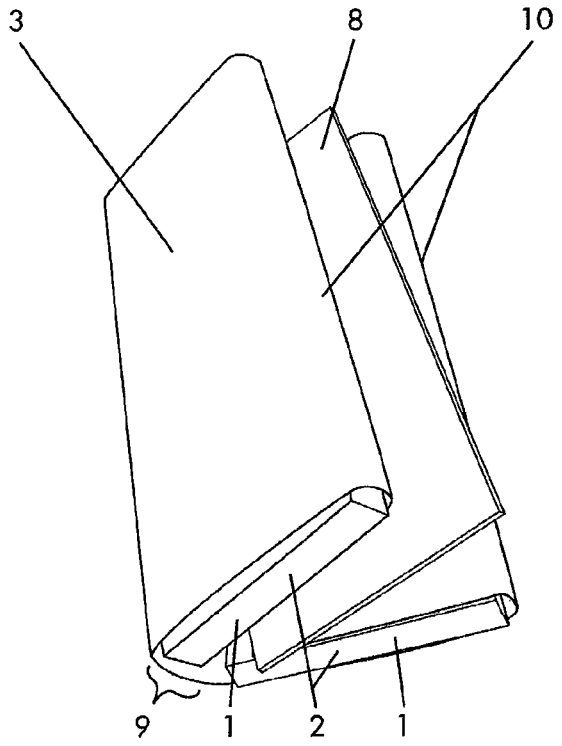
Fig: 5
Fig: 6
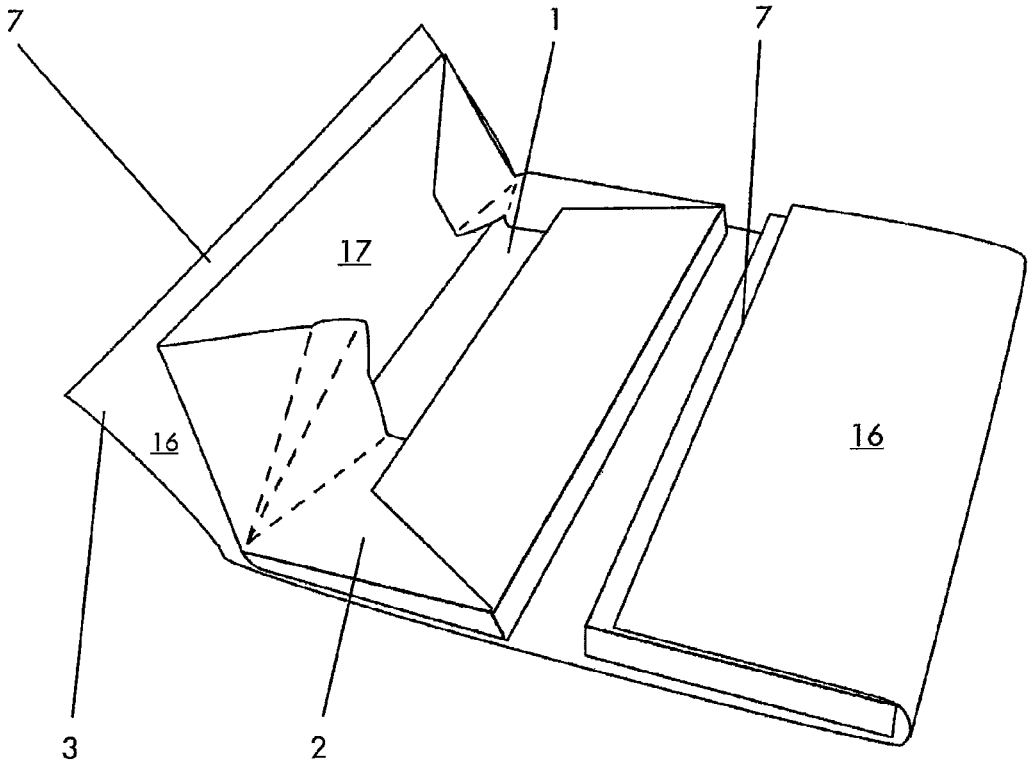

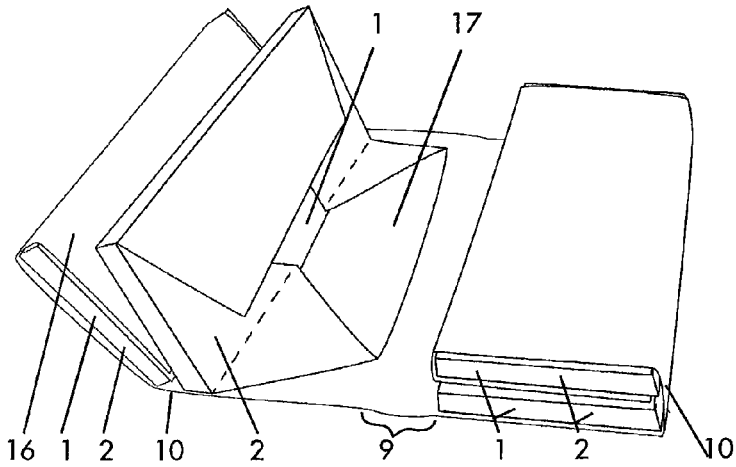
Fig: 14
Fig: 15
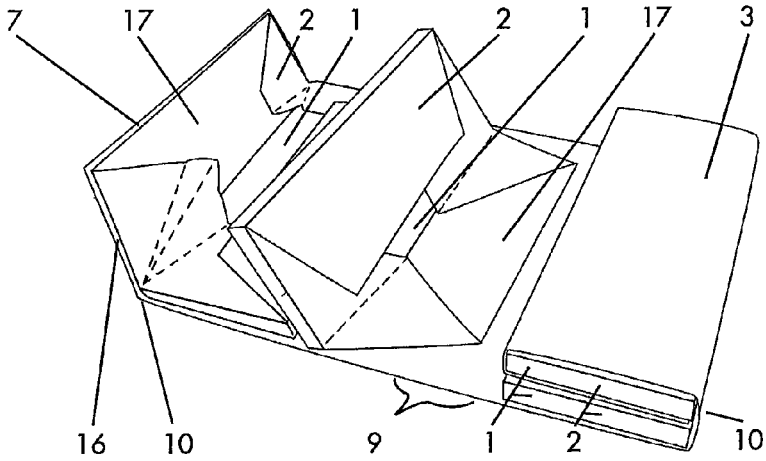
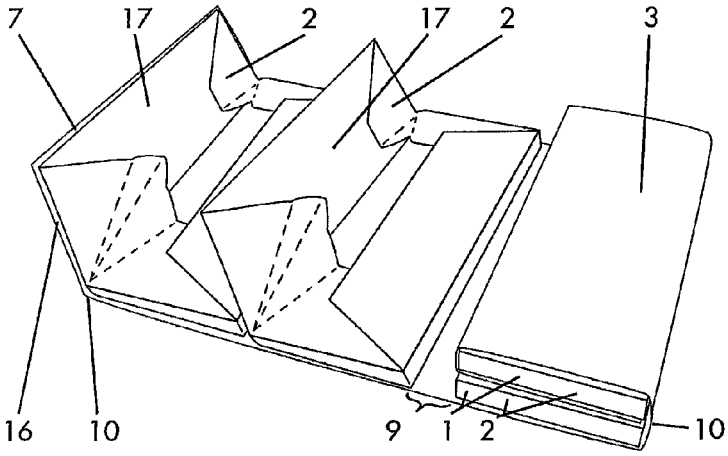
Fig: 16

Fig: 20
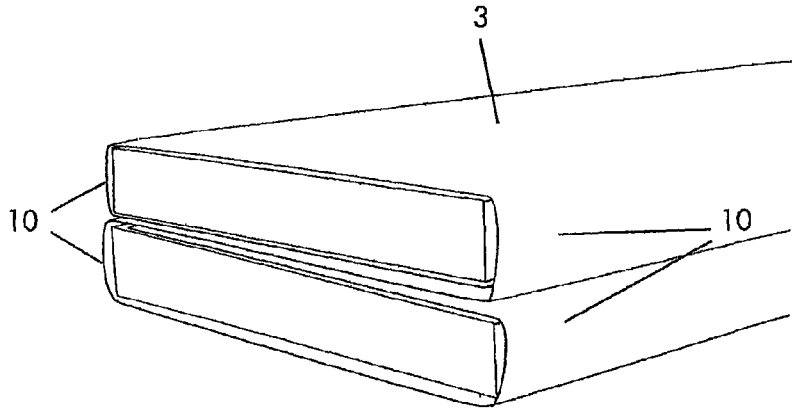
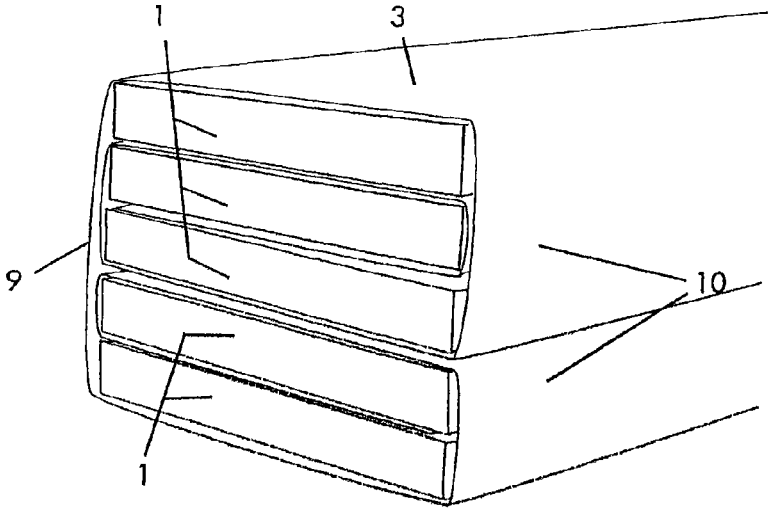
Fig: 21

PACKAGING FOR TWO OR MORE BARS LOCATED ONE ABOVE THE OTHER

The invention relates to a packaging for foodstuffs and/or semi-luxury products produced in the form of bars, such as chocolate bars, containing two or more bars lying on top of each other, wherein each bar is wrapped in a sheet on all sides and the bar thus wrapped is enveloped by a wrapper sheet.

According to the prior art, chocolate bars are enveloped in a closed manner by the wrapper sheet (banderole) in the circumferential direction so that the wrapper sheet forms a closed loop extending across the entire circumference of the chocolate bar, whereby the ends of the wrapper sheet end up lying on top of each other on the reverse side of the chocolate bar and are stuck together. When being removed from the wrapper sheet, the chocolate bar is pushed out transversely to the circumferential direction and unwrapped from the sheet. In doing so, the chocolate bar is usually encased in the sheet folded in the shape of an envelope, whereby the envelope flaps end up lying on the bottom side or reverse side, respectively, of the chocolate bar.

If such chocolate bars get into circulation individually, they require a certain minimum thickness in order to withstand transport and being arranged in store shelves, respectively, and, furthermore, being removed by a customer, being stowed away in a shopping bag or basket etc. without breaking. If one wishes to remain under said minimum thickness, it is necessary to support each bar with a piece of cardboard which is also enveloped by the wrapper sheet.

If such a piece of cardboard is dispensed with, it is, in turn, necessary for particularly thin chocolate bars that those bars, which, in each case, are enveloped by a wrapper sheet, are stacked and placed in a separate box displaying the stiffness required for transport.

The invention aims at avoiding said disadvantages and difficulties and its object is to provide a novel packaging of the initially described kind for foodstuffs and/or semi-luxury products produced in the form of bars, which packaging enables such bars to be formed also very thinly and to be placed on the market while being largely protected against breakage and while consuming a minimum amount of packaging material.

According to the invention, said object is achieved in that all bars lie flatly on top of each other in the form of a stack of bars and are wrapped in a single continuous wrapper sheet embracing those two or said several bars, respectively, namely on at least three adjacent sides of each individual bar, with all fold lines of the wrapper sheet running parallel to each other.

A further embodiment of a packaging for foodstuffs and/or semi-luxury products produced in the form of bars, such as chocolate bars, for two or more bars lying on top of each other, wherein each bar is wrapped in a sheet on all sides and the bars thus wrapped are enveloped by a wrapper sheet, wherein all bars lie flatly on top of each other in the form of a stack of bars, is characterized in that all bars lying on top of each other are wrapped in a single continuous wrapper sheet embracing those two or said several bars, respectively, namely on at least three, preferably on four adjacent sides of each individual bar, whereby the bars are encased in a sheet folded in the shape of an envelope and in each case one envelope flap is attached, preferably stuck, to a portion of the wrapper sheet surrounding it.

The following prior art is known:

U.S. Pat. No. 2,210,194 A shows a packaging for chewing gum, wherein the individual strips of chewing gum are in each case protectively wrapped in a sheet and also lie on top of each other like bars on a stack. The stack of individual strips of chewing gum is provided with a printable wrapper sheet which, however, envelops the entire stack on two or more sides only on the outside.

US 2005 252 809 A1 shows a packaging for foodstuffs and semi-luxury products etc. which is made up of two separate compartments (an upper and a lower compartment). Each of the compartments is formed from a separate paperboard envelope. The envelopes are folded, whereby the compartments are formed. Thereupon, the lower compartment is attached to the upper compartment in a fashion that allows the lower compartment to be later detached along a perforation, when said lower compartment is empty.

U.S. Pat. No. 2,192,473 A reveals a packaging of the initially mentioned kind for chewing gum which can be opened in the manner of a book and comprises several (in the drawing six) compartments for the strips of chewing gum. The individual compartments for the chewing gums are therein arranged side by side.

U.S. Pat. No. 2,210,196 A reveals a packaging for chewing gum which connects several chewing gums in an accordion-like fashion. The individual strips are indeed arranged in the form of a stack, however, except for the first strip, they are covered by a common wrapper sheet only on two sides.

DE 91 00 629 U1 shows a packaging for two stacks of cellulose cloths, wherein two compartments are formed which in each case receive one of those stacks. The sheet forming the compartments is formed from two interconnected, multiply folded sheets.

According to a preferred variant of the invention, the wrapper sheet encases all bars on one side, preferably on a narrow longitudinal side, of the stack of bars in the form of a closed book-like back. In this way, the bars can be removed from the packaging particularly easily by opening the packaging like a book.

Preferably, the wrapper sheet encloses the bars, creating a book form comprising at least two pages, whereby it is possible that each of the pages of the book form in turn contains two or more bars.

A preferred variant is characterized in that only two bars are enveloped by a wrapper sheet, wherein an inner tongue of the wrapper sheet is in each case provided between the two bars arranged on top of each other so that the wrapper sheet extends outwards around a first bar, starting from the area between the two bars, around said first bar and across the second bar and back into the area between the two bars.

A further suitable variant is characterized in that an insert exceeding the wrapper sheet in terms of its stiffness, such as a piece of cardboard, is provided between two bars arranged on top of each other. Said insert can serve for increasing the stiffness of the entire stack of bars, or also merely for adding information regarding the contents and composition of the bars.

Preferably, the insert is placed between two parts of the wrapper sheet.

Another preferred embodiment envisages that the bars wrapped in the wrapper sheet are secured against opening by means of a safety device, with the safety device suitably being formed from an adhesive label. Thereby, when unwrapping the bars, the safety device must either be removed or cut through. Therefore, such a safety device simultaneously provides evidence guaranteeing that the packaging including the bars is still intact, i.e., unopened.

For a particularly easy removal of a bar, the packaging is characterized in that the bars are encased in a sheet folded in the shape of an envelope, wherein in each case one envelope flap is attached, preferably stuck, to a portion of the wrapper sheet surrounding it and the front side of each bar faces the side of the envelope flaps.

The wrapper sheet is preferably dimensioned for bar thicknesses from 2 to 10 mm, preferably from 2 to 5 mm.

The wrapper sheet can surround at least two bars in a helical form, according to another variant also in a meander form.

One feature of the invention is that both end regions of the wrapper sheet end up lying between two bars.

Below, the invention is illustrated in further detail on the basis of several exemplary embodiments depicted in the drawing.

FIGS. 1 to 21 illustrate packagings according to the invention for different variants, in each case in an oblique view.

According to FIG. 1, two chocolate bars 1 are packaged according to the invention, wherein the chocolate bars 1—which, for example, are chocolate bars 1 of 35 g each—are individually packaged in sheets 2, e.g., in silver or gold sheets, in the form of envelopes. The two chocolate bars 1 are arranged so as to be stacked on top of each other and are covered with regard to the circumference by a wrapper sheet 3, wherein the shorter narrow sides 4 of the chocolate bars 1 are not covered by the wrapper sheet 3.

The wrapper sheet 3 extends between the chocolate bars 1 with a bow 10 across the narrow longitudinal side 5 of a chocolate bar 1 across the outer surface 6 thereof, then across the two narrow longitudinal sides 5 of the two chocolate bars 1, across the outer surface 6 of the second chocolate bar 1 and again with a bow 10 across the narrow longitudinal side 5 of the second chocolate bar 1 as far as into the region between the chocolate bars 1 so that both end regions 7 of the wrapper sheet 3 will in each case end up lying between two chocolate bars 1.

A piece of cardboard 8 is inserted between the two end regions 7 of the wrapper sheet 3, which, for example, may be printed with information regarding the product.

As can be seen from FIG. 1, the two chocolate bars 1 together with the wrapper sheet 3 form a packaging in the manner of a book comprising a back 9 and two pages, whereby the book is prevented from being opened by an adhesive label 11 extending across two narrow longitudinal side faces 5 and the bows 10, respectively, of the chocolate bars.

Figure 2:
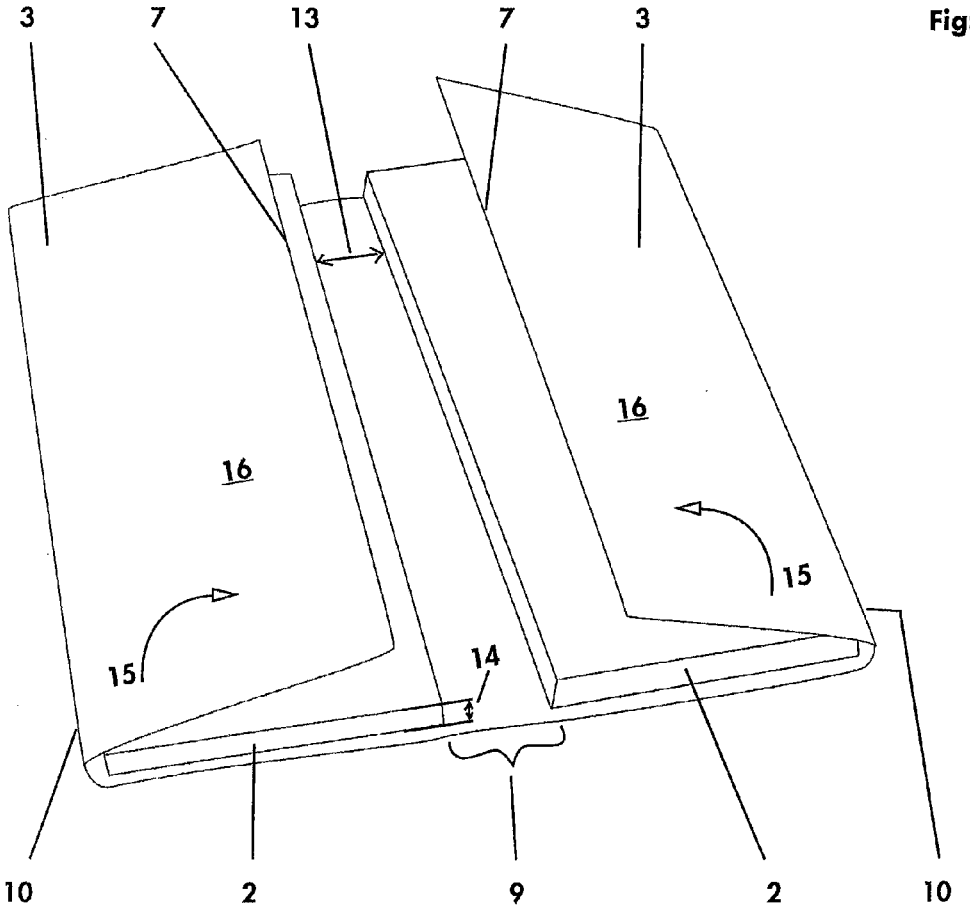
Figure 4:
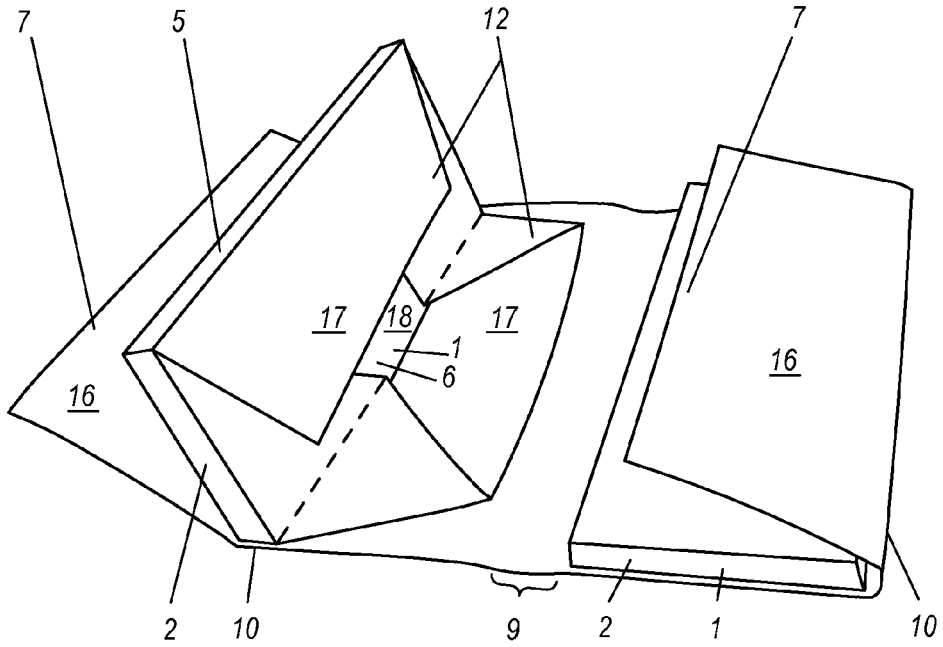
Figure 7:
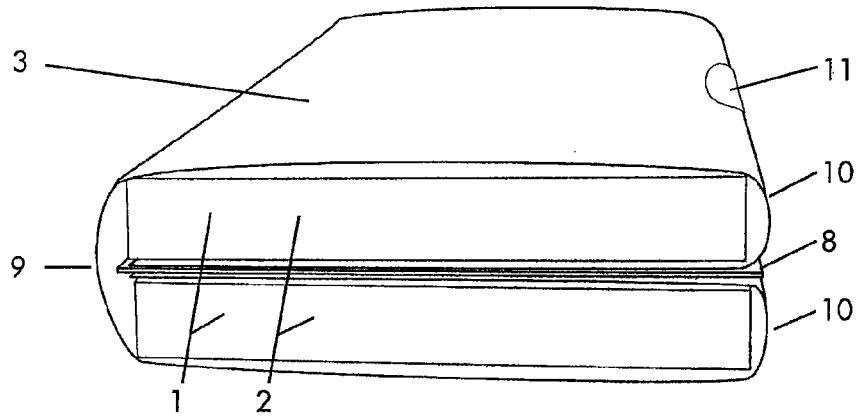

As can be seen from FIGS. 2 and 4, the chocolate bars 1 are placed with the envelope closure 12 facing downwards on the wrapper sheet 3, which is dimensioned with a length of 220 mm and a width of 121 mm for example for chocolate bars 1 of 35 g each. The distance 13 between the chocolate bars 1 is slightly larger than the thickness 14 of the two chocolate bars 1. The free end regions 7 of the wrapper sheet 3 are then placed over the chocolate bars 1, whereby two inner tongues 16 are formed. The package illustrated in FIG. 1 is formed by folding in the direction of the arrows 15, whereupon the adhesive label 11 is attached after the piece of cardboard 8, which is optionally provided, has been inserted. The packaging then has a dimension of, e.g., 51×121×14 mm.

The piece of cardboard 8 is not absolutely necessary; it can also be dispensed with, provided that the very thin chocolate bars 1 exhibit sufficient stability against breakage during transport in the stacked state. In this connection, it must be noted that a substantial increase in the strength of the packaging, as compared to conventional bows as used for chocolate bars 1, is provided alone by the two inner tongues 16 and the edges of the wrapper sheet 3.

The adhesive label 11 may be designed in various ways with regard to its shape. It is also conceivable to encompass the wrapper sheet 3 with a continuous loop instead of the adhesive label 11 or to stick the inner tongue 16 together on the abutting sides.

Figure 3:
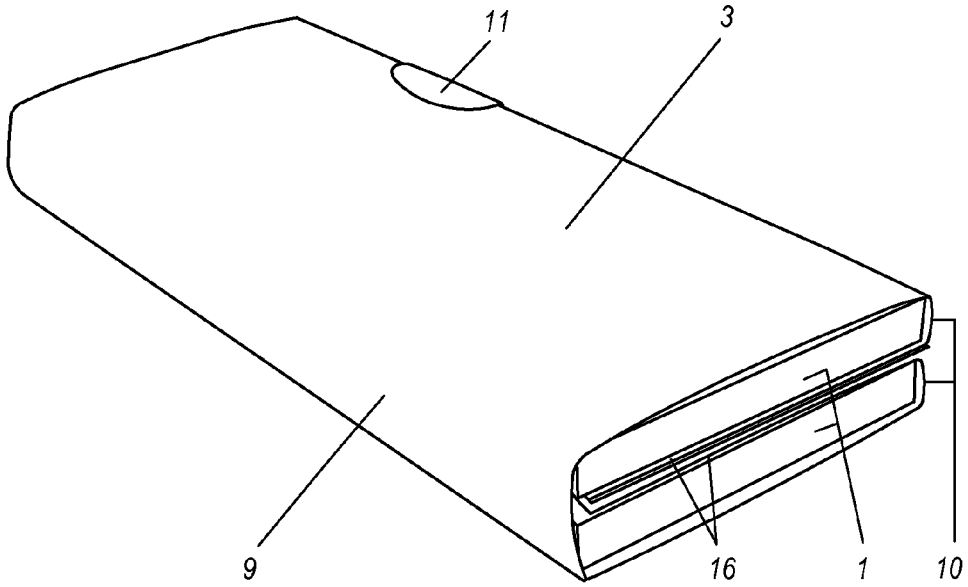

A packaging without a piece of cardboard is illustrated in FIG. 3.

The opening of the packaging 1 takes place according to FIG. 4, namely after removing the adhesive label 11 or tearing it open. Thereafter, the package is folded apart, that is, the book is opened, and the two chocolate bars 1 can be removed. It is advantageous if, in each case, one of the envelope flaps 17 of each of the two sheets 2 is attached, e.g., stuck, to the wrapper sheet 3 so that said envelope flap 17 will open automatically when the chocolate bars 1 are lifted, as is illustrated in FIG. 4. Then, the chocolate bar 1 will preferably reveal its beautiful top side 18 to the beholder, which might also be adorned with a pattern. Traditionally, the chocolate bars 1 are packaged such that the reverse side of the chocolate bar is seen first when the envelope flap is opened.

FIG. 6 shows the opening of the sheet, wherein the envelope flap 17 is attached to the inside of the inner tongue 16, in an illustration analogous to FIG. 4.

By sticking the envelope flap 17 to the wrapper sheet 3, a chocolate bar 1 is also reliably prevented from sliding out of the wrapper sheet 3.

Figure 8:
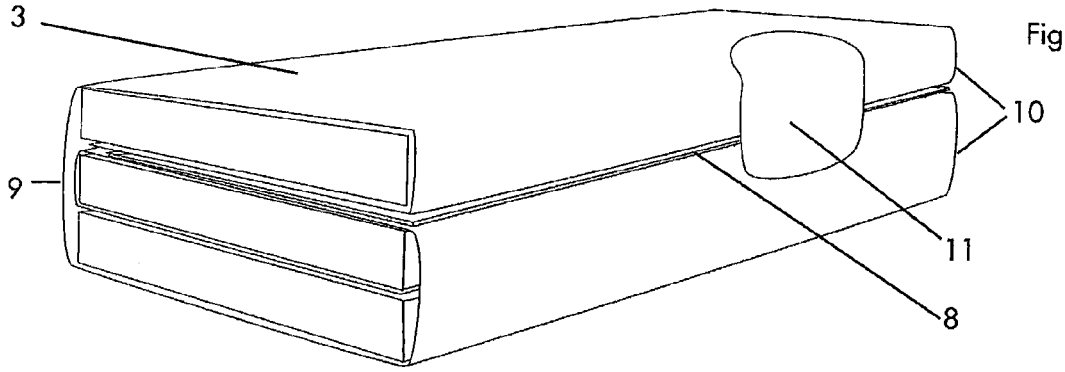
Figure 9:
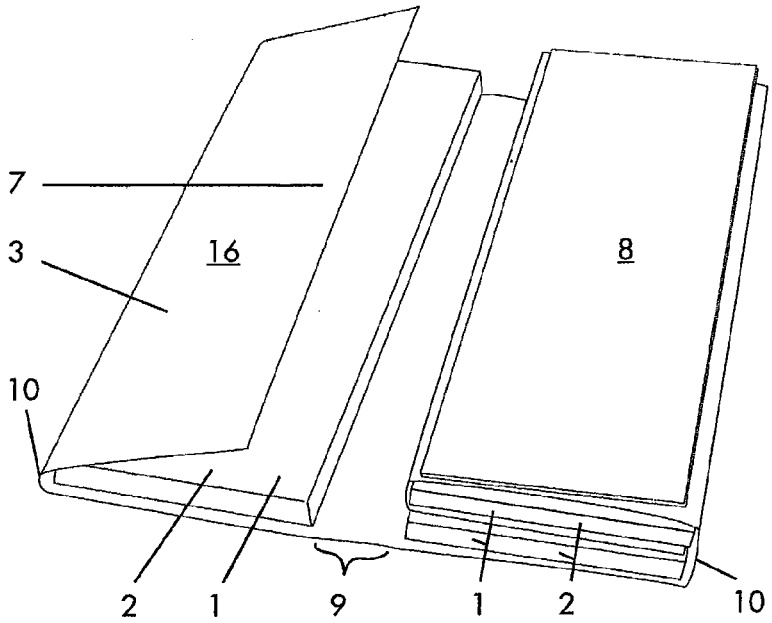
Figure 10:
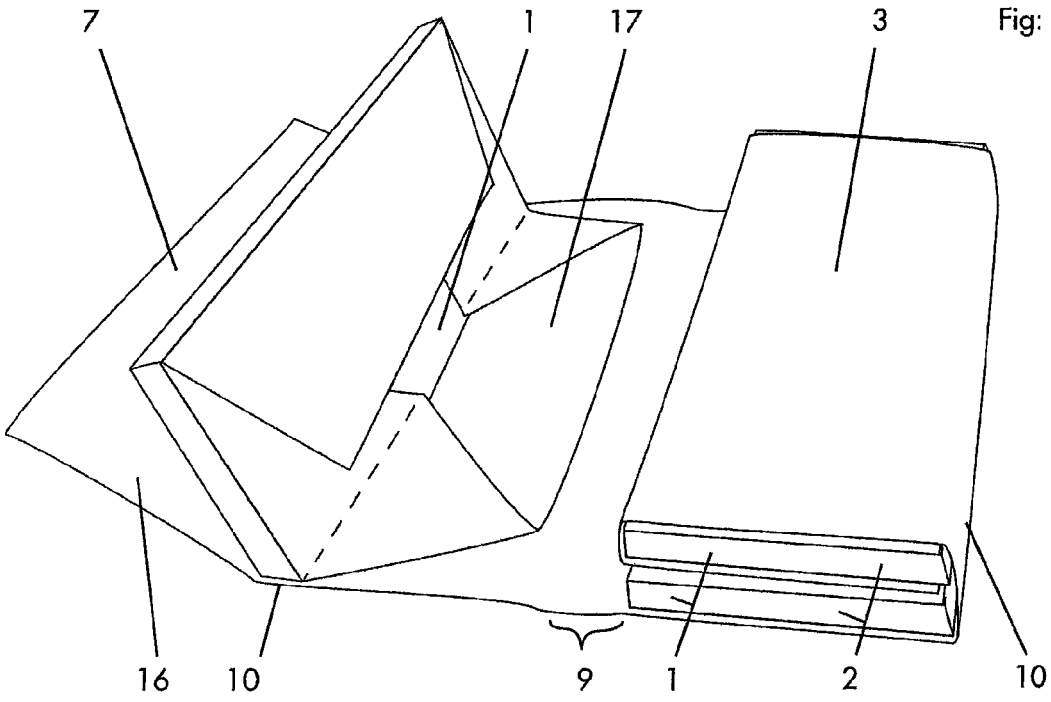
Figure 11:
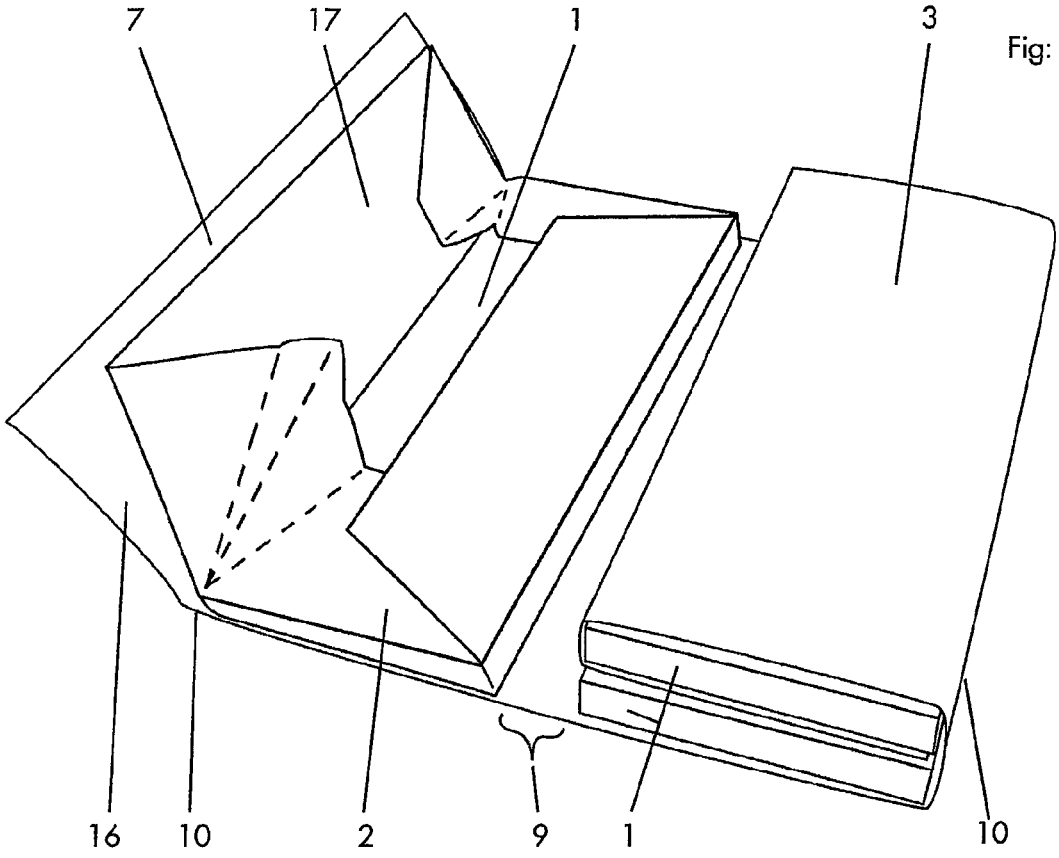
Figure 12:
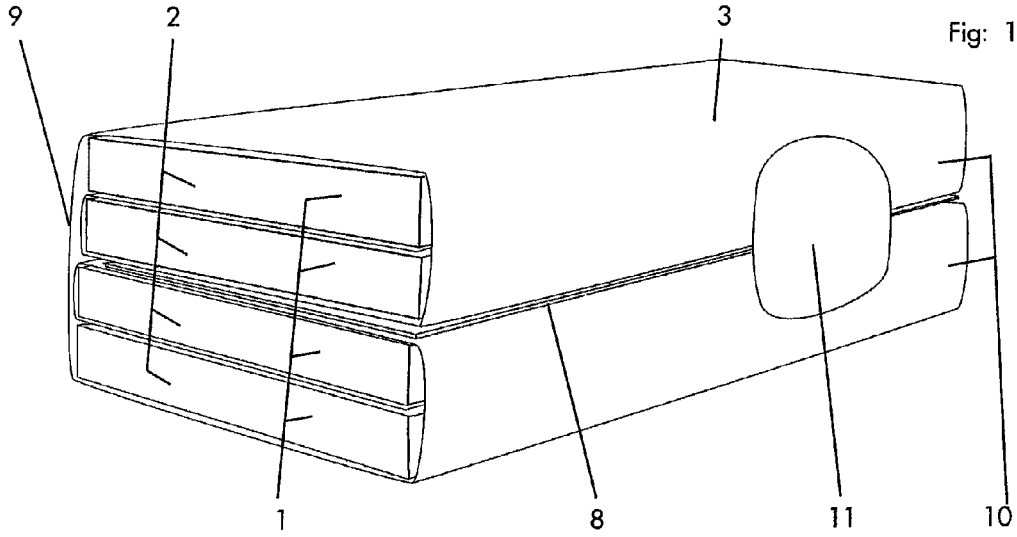
Figure 13:
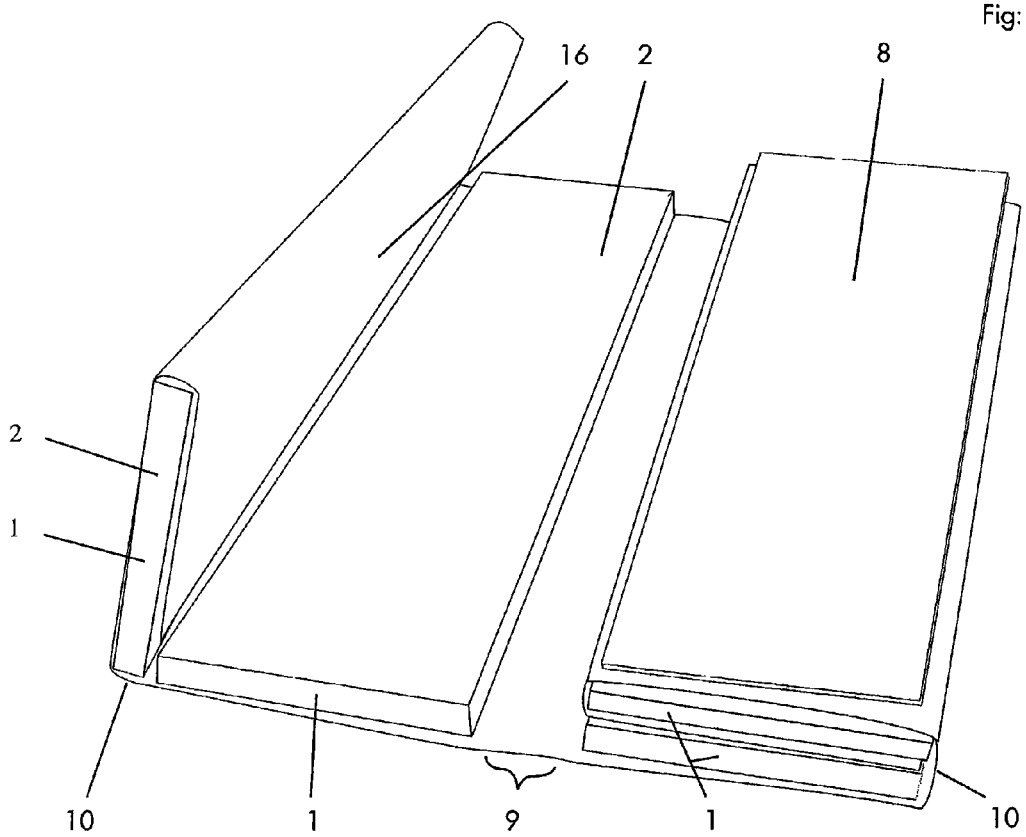
Figure 18:
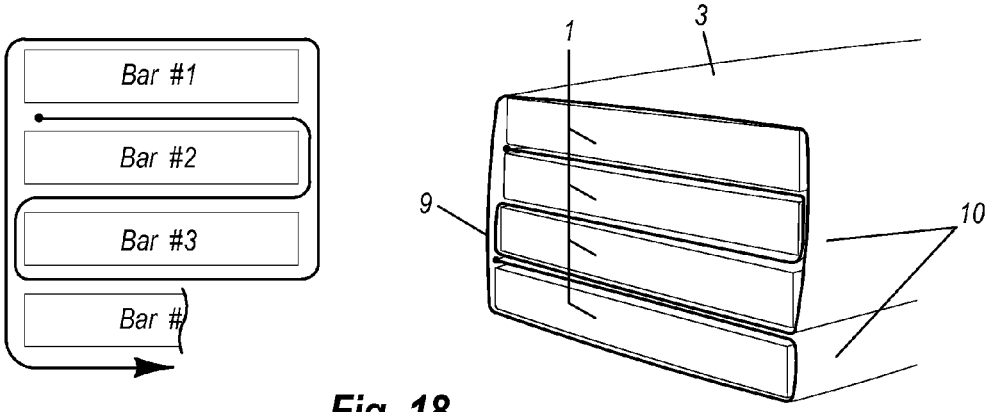
Figure 19:
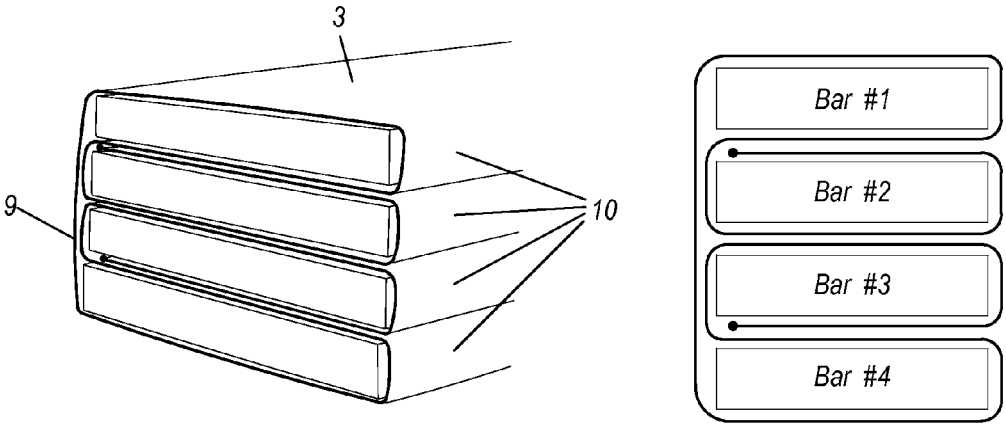

In FIGS. 8 to 1T, a packaging according to the invention for three chocolate bars 1 stacked on top of each other is depicted, wherein one of the chocolate bars 1 is enveloped by the wrapper sheet 3, along the lines of the variant illustrated in FIG. 1, and the other two chocolate bars 1 lying on top of each other are encased by the wrapper sheet 3 extending in a helical form.

FIGS. 12 to 16 show a variant for four stacked chocolate bars 1, wherein in each case two chocolate bars 1 are likewise enclosed by a wrapper sheet 3 extending in a helical form.

FIGS. 15 and 16 show different manners of attaching the envelope flaps 16 of the sheet 2 of the chocolate bars 1 to the wrapper sheet 3, resulting in different manners of opening.

Figure 17:
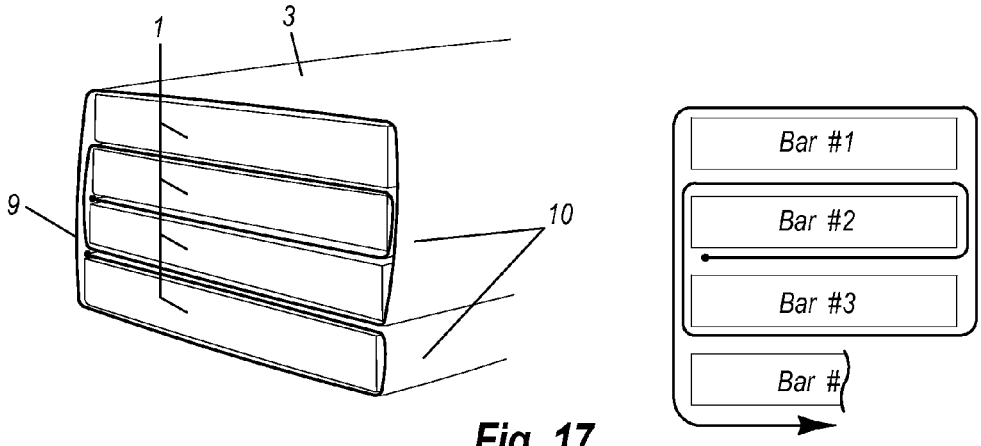
Figure 17A:
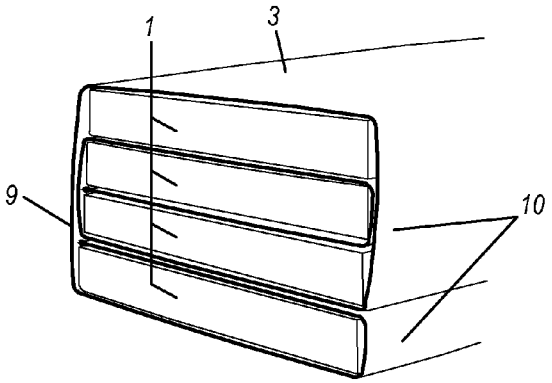
Figure 17B:
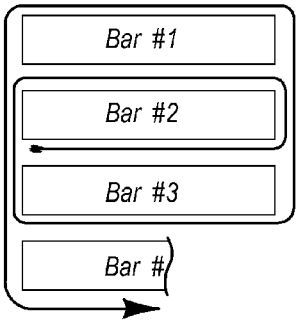

FIGS. 17A and B shows a variant wherein, in total, four chocolate bars 1 arranged in a stacked manner are packaged in a packaging, with the wrapper sheet 3 enclosing, on the one hand, one chocolate bar 1 and, on the other hand, three chocolate bars 1 and the wrapper sheet 3 again extending across the three chocolate bars 1 in helical form. A packaging in book form comprising a back 9 and two pages, with one of them comprising three chocolate bars 1 and the other one comprising only a single chocolate bar 1, is formed also in this way.

Figure 18A:
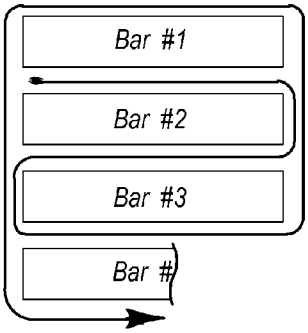
Figure 18B:
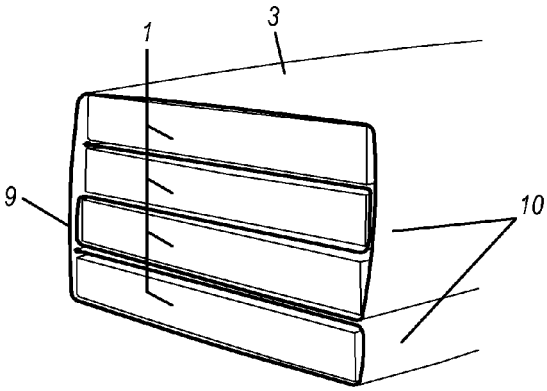

According to FIGS. 18A and B, which illustrates a further embodiment for four stacked chocolate bars 1, the wrapper sheet 3 extends in meander form across three of the chocolate bars 1, in contrast to FIGS. 17A and B.

Figure 19A:
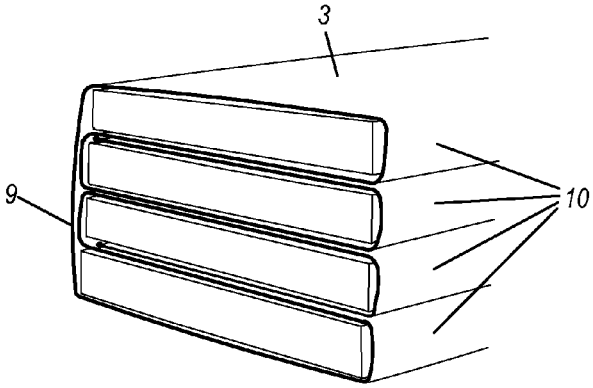
Figure 19B:
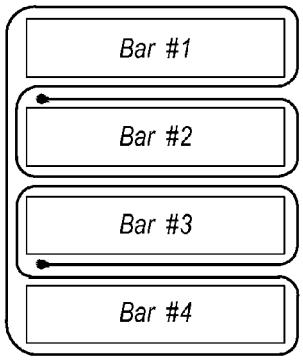

A meander-shaped enlacement of four chocolate bars 1 is illustrated in FIGS. 19A and B.

FIG. 20 shows a variant for a packaging of two chocolate bars 1 according to which the chocolate bars 1 are not packaged in book form; rather, this packaging allows the packaging to be opened from both narrow longitudinal sides 5 of the chocolate bars 1 so that both longitudinal sides of the package would also have to be secured with an adhesive label 1.

FIG. 21, in turn, shows a variant for five chocolate bars 1 stacked on top of each other, whereby a back 9 according to a book is again formed in that case.

Of course, it is conceivable to package the chocolate bars or other bar-shaped foodstuffs and/or semi-luxury products, respectively, first—i.e., prior to wrapping them in the wrapper sheet according to the invention—in a tubular bag instead of in an envelope.

The terms "sheet" and "wrapper sheet", respectively, encompass any thin flexible sheet, i.e., also those made from plastic, metal, paper etc.

For all packaging types according to the invention, it is essential that the chocolate bars 1 wrapped individually in the sheet 2 are covered protectively by the wrapper sheet on at least three sides, two of which are the largest ones by surface area.

The invention claimed is:

1. A packaging for foodstuffs and/or semi-luxury products produced in the form of bars, containing two or more bars lying on top of each other, wherein each bar is wrapped in a sheet on all sides and the bars thus wrapped are enveloped by a single continuous wrapper sheet, characterized in that all the bars lie flatly on top of each other in the form of a stack of bars and all the bars lying on top of each other are embraced by the single continuous wrapper sheet, wherein the single continuous wrapper sheet is located next to at least three adjacent sides of each individual bar and embraces these three adjacent sides altogether with the sheet of each individual bar between the individual bar and the single continuous wrapper sheet, with all fold lines of the wrapper sheet running parallel to each other.

2. A packaging according to claim 1, characterized in that all the bars lying on top of each other are wrapped in the single continuous wrapper sheet embracing the two or more bars on four adjacent sides of each individual bar, wherein each of the bars is encased in the sheet folded in the shape of an envelope and in each case one envelope flap is attached to a portion of the wrapper sheet surrounding the sheet.

3. A packaging according to claim 1, characterized in that the wrapper sheet encases all the bars on one side, on a narrow longitudinal side, of the stack of bars in the form of a closed book-like back.

4. A packaging according to claim 3, characterized in that the wrapper sheet encloses the bars, creating a book form comprising at least two pages.

5. A packaging according to claim 3, characterized in that only two bars are enveloped by the wrapper sheet, wherein an inner tongue of the wrapper sheet is in each case provided between the two bars arranged on top of each other so that the wrapper sheet extends outwards around a first bar, starting from the area between the two bars, around said first bar and across the second bar and back into the area between the two bars, wherein the single continuous wrapper sheet embraces at least three adjacent sides of each individual bar altogether.

6. A packaging according to claim 1, characterized in that an insert exceeding the wrapper sheet in terms of its stiffness, such as a piece of cardboard, is provided between two bars arranged on top of each other.

7. A packaging according to claim 6, characterized in that the insert is placed between two inner tongues of the wrapper sheet.

8. A packaging according to claim 1, characterized in that the bars wrapped in the wrapper sheet are secured against opening by means of a safety device.

9. A packaging according to claim 8, characterized in that the safety device is formed from an adhesive label.

10. A packaging according to claim 2, characterized in that the front side of each bar faces the side of the envelope flaps when the envelope is closed.

11. A packaging according to claim 1, characterized in that the bars are encased in a sheet folded in the shape of an envelope and in each case one envelope flap is attached, preferably stuck, to a portion of the wrapper sheet surrounding it and wherein the front side of each bar faces the side of the envelope flaps.

12. A packaging according to claim 1, characterized in that the wrapper sheet is dimensioned for bar thicknesses of from 2 to 10 mm, preferably from 2 to 5 mm.

13. A packaging according to claim 1, characterized in that the wrapper sheet surrounds at least two bars in a helical form.

14. A packaging according to claim 1, characterized in that the wrapper sheet surrounds at least two bars in a meander form.

15. A packaging according to any of claims 1 to 14, characterized in that both end regions of the wrapper sheet end up lying between two bars.

16. A packaging for products produced in the form of bars and containing two or more bars lying on top of each other, the packaging comprising:

a plurality of sheets, wherein all sides of each bar is wrapped in one of the plurality of sheets and each sheet includes envelope flaps;

a single continuous wrapper sheet, wherein:

the single continuous wrapper sheet includes folds, wherein all the folds are parallel;

the single continuous wrapper is wrapped around the two or more bars such that the single continuous wrapper is next to at least three adjacent sides of each bar; and the single continuous wrapper sheet is stuck to an envelope flap of at least one of the plurality of sheets such that the envelope flap automatically opens when the wrapper sheet is lifted.

* * * * *